US009892697B2

(12) United States Patent
Shin

(10) Patent No.: US 9,892,697 B2
(45) Date of Patent: Feb. 13, 2018

(54) DISPLAY APPARATUS AND METHOD OF DRIVING A DISPLAY PANEL

(71) Applicant: Samsung Display Co., Ltd., Yongin-si (KR)

(72) Inventor: Yonghwan Shin, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 117 days.

(21) Appl. No.: 14/988,317

(22) Filed: Jan. 5, 2016

(65) Prior Publication Data

US 2016/0379576 A1 Dec. 29, 2016

(30) Foreign Application Priority Data

Jun. 25, 2015 (KR) ..... 10 2015 0090491

(51) Int. Cl.
*G09G 3/36* (2006.01)

(52) U.S. Cl.
CPC ..... *G09G 3/3607* (2013.01); *G09G 3/3685* (2013.01); *G09G 2310/027* (2013.01); *G09G 2320/0252* (2013.01); *G09G 2320/0276* (2013.01)

(58) Field of Classification Search
CPC ..... G09G 2310/027; G09G 2320/0252; G09G 2320/0276; G09G 3/3607; G09G 3/3685
See application file for complete search history.

(56) References Cited

U.S. PATENT DOCUMENTS 7,119,864 B2 * 10/2006 Jang ..... G02F 1/133371 345/88
2003/0214473 A1 11/2003 Lee
2006/0267913 A1 * 11/2006 Mochizuki ..... G09G 3/3688 345/100
2009/0207328 A1 8/2009 Hur et al.
2012/0056915 A1 * 3/2012 Shibazaki ..... G02F 1/133371 345/690
2015/0116374 A1 4/2015 Shin et al.

FOREIGN PATENT DOCUMENTS

KR 1020030089072 11/2003
KR 1020090090132 8/2009
KR 1020120066323 6/2012

* cited by examiner

*Primary Examiner* — Latanya Bibbins
(74) *Attorney, Agent, or Firm* — H.C. Parks & Associates

(57) ABSTRACT

A display apparatus includes a display panel that includes a liquid crystal layer, a first pixel having the liquid crystal layer with a first thickness, a second pixel having a color filter and the liquid crystal layer with a second thickness. The display apparatus also includes a data generating unit configured to generate a first image signal corresponding to the first pixel and a second image signal corresponding to the second pixel in response to an input image signal, a data converting unit configured to convert a gradation value of the first image signal into a conversion gradation value of the first image signal according to refractive index anisotropy and the first thickness of the liquid crystal layer, and a driving unit configured to output to the first pixel a first data voltage corresponding to the compensation gradation value of the first image signal.

19 Claims, 7 Drawing Sheets

DISPLAY APPARATUS AND METHOD OF DRIVING A DISPLAY PANEL

CROSS-REFERENCE TO RELATED APPLICATION

This application claims priority from and the benefit of Korean Patent Application No. 10-2015-0090491, filed on Jun. 25, 2015, which is hereby incorporated by reference for all purposes as if fully set forth herein.

BACKGROUND

Field

Exemplary embodiments relate to a display apparatus and a method of driving a display panel. More particularly, exemplary embodiments relate to a display apparatus including pixels having liquid crystal layers with different thicknesses and a method of driving a display panel.

Discussion of the Background

A general display apparatus includes a first substrate having a plurality of pixels, a second substrate disposed to face the first substrate and having a common electrode, and a liquid crystal layer disposed between the first substrate and the second substrate. An electrical field is generated between a pixel electrode and the common electrode according to a voltage difference between a data voltage supplied to a data electrode and a common voltage applied to the common electrode. Liquid crystal molecules of the liquid crystal layer are driven according to the electrical field generated between the pixel electrode and the common electrode. As a result, the amount of light transmitting through the liquid crystal layer changes to display an image.

Generally, pixels of the display apparatus include a liquid crystal material and have the same thickness to have the same optical characteristics. However, in the display apparatus including a white pixel, for example, a planarization process is additionally performed to fill a space corresponding to a thickness of a color filter with a material since the white pixel does not have a color filter.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a display with improved response speed.

Additional aspects will be set forth in part in the description which follows and, in part, will be apparent from the disclosure, or may be learned by practice of the inventive concept.

An exemplary embodiment discloses a display apparatus including a display panel including a liquid crystal layer, a first pixel having the liquid crystal layer with a first thickness and a second pixel having the liquid crystal layer with a second thickness and having a color filter disposed at a top or bottom portion of the liquid crystal layer, the second thickness is less than the first thickness. The display apparatus also includes a data generating unit configured to generate a first image signal corresponding to the first pixel and a second image signal corresponding to the second pixel in response to an input image signal, a data converting unit configured to convert a gradation value of the first image signal into a conversion gradation value of the first image signal according to refractive index anisotropy and the first thickness of the liquid crystal layer, a first frame memory configured to store the conversion gradation value of the first image signal for a period of a frame, a first data compensating unit configured to generate a compensation gradation value of the first image signal according to the conversion gradation value of the first image signal generated from the data converting unit and the conversion gradation value of the first image signal stored in the first frame memory, and a driving unit configured to output to the first pixel a first data voltage corresponding to the compensation gradation value of the first image signal.

An exemplary embodiment also discloses a driving method of a display panel. The method includes generating a first image signal corresponding to a first pixel of the display panel and a second image signal corresponding to a second pixel of the display panel, the display panel including a liquid crystal layer with a first thickness in the first pixel and a second thickness in the second pixel that is less than the first thickness. The method includes outputting to the first pixel a first data voltage of a first driving voltage section in response to a gradation value of the first image signal when the gradation value of the first image signal of a previous frame and the gradation value of the first image signal of a current frame are the same, outputting to the first pixel an overdriving voltage higher than the first driving voltage section when the gradation value of the first image signal of the current frame is greater than the gradation value of the first image signal of the previous frame by a predetermined value, and outputting a second data voltage of a second driving voltage section comprising the first driving voltage section in response to the gradation value of the second image signal. The second pixel has a color filter disposed at a top or bottom portion of the liquid crystal layer.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept and are incorporated in and constitute a part of this specification, illustrate exemplary embodiments of the inventive concept, and together with the description, serve to explain principles of the inventive concept.

DETAILED DESCRIPTION OF THE ILLUSTRATED EMBODIMENTS

Figure 1:
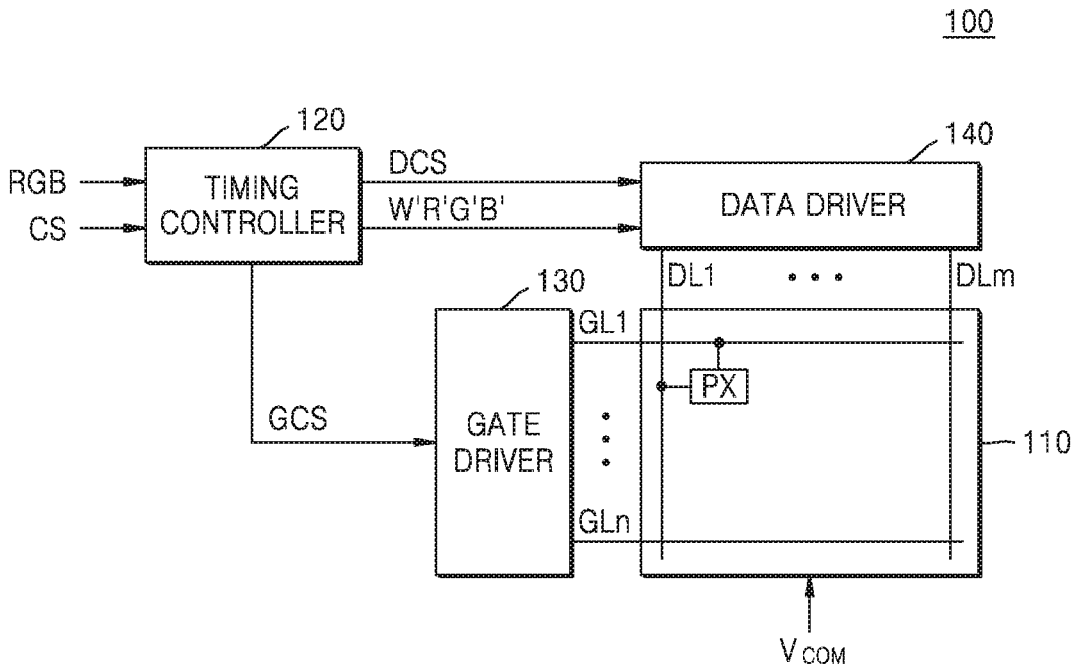
FIG. 1 is a block diagram illustrating a display apparatus according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element is or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a block diagram illustrating a display apparatus according to an exemplary embodiment.

Referring to FIG. 1, the display apparatus 100 may include a display panel 110, a timing controller 120, a gate driver 130, and a data driver 140.

The display panel 110 may include gate lines GL1-GLn, a data lines DL1-DLm, and pixels PX arranged in a matrix. The gate lines GL1-GLn and the date lines DL1-DLm may cross each other while also being insulated from each other. The pixels PX may be connected to their corresponding gate lines GL1-GLn and their corresponding data lines DL1-DLm.

The pixels may include a red pixel to display a red color, a green pixel to display a green color, a blue pixel to display a blue color, and a white pixel to display a white color. The white pixel may be referred to as a first pixel. The red pixel, the green pixel, and the blue pixel may be referred to as a second pixel. The second pixel may include a color filter to display one of the red color, green color, and blue color.

The gate lines GL1-GLn may extend in a column direction to be connected to the gate driver 130. The gate lines GL1-GLn may sequentially receive gate signals from the gate driver 130.

The data lines DL1-DLm may extend in a row direction to be connected to the data driver 140. The data lines DL1-DLm may sequentially receive data signals from the data driver 140.

The timing controller 120 may receive image signals RGB and controls signals CS from outside the timing controller 120 (e.g., a system board). The timing controller 120 may convert a data format of the image signals RGB to correspond to an interface specification of the data driver 140. The timing controller 120 may provide the data driver 140 with the format-converted image signals W'R'G'B'. The image signals W'R'G'B' may include a first image signal W' to correspond to the first pixel and second image signals R'G'B' to correspond to the second pixel.

The timing controller 120 may generate a gate control signal GCS and a data control signal DCS in response to the control signals CS. The gate control signal GCS may be a control signal to control a driving timing of the gate driver 130. The data control signal DCS may be a control signal to control a driving timing of the data driver 140. The timing controller 120 may provide the gate control signal GCS to the gate driver 130. The timing controller 120 may provide the data control signal DCS to the data driver 140.

The gate driver 130 may output gate signals in response to the gate control signal GCS. The data driver 140 may convert the image signals W'R'G'B' into data voltages in response to the data control signal DCS. The data driver 140 may output the data voltages to the display panel 110. The data voltages may be defined as data voltages corresponding to gradations of the image signals W'R'G'B'. The data voltages may include a first data voltage to correspond to the gradation of the first image signal W' and second voltages to correspond to gradations of the second image signals R'G'B'. The first data voltage may be included in a first driving voltage section and the second data voltage may be included in a second driving voltage section.

The gate signals may be provided to the pixels through the gate lines GL1-GLn in a unit of rows. The data voltages may be provided to the pixels through the data lines DL1-DLm. The pixels PX may receive the data voltages in response to the gate signals. The pixels PX may display the gradations corresponding to the data voltages.

The pixels PX of the display panel 110 may receive a common voltage Vcom and the data voltages to display images. These structures will be explained in detail below.

Figure 2:
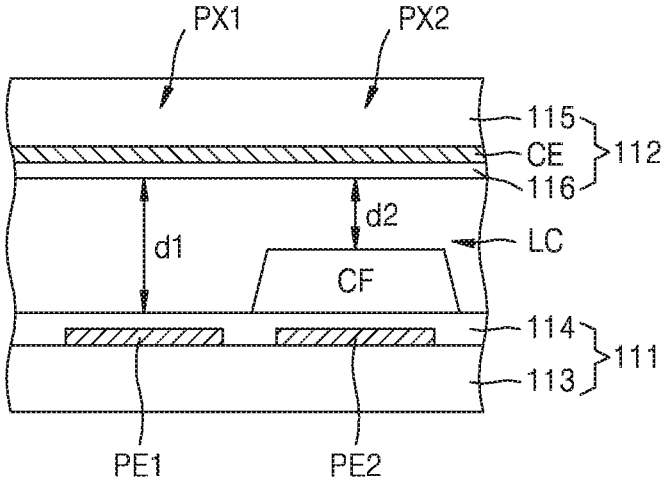
FIG. 2 is a cross-sectional view illustrating a display panel of a display apparatus according to an exemplary embodiment.

FIG. 2 is a cross-sectional view illustrating the display panel 110 of the display apparatus 100 according to an exemplary embodiment.

Referring to FIG. 2, the display panel 110 may include a first pixel PX1 and a second pixel PX2. As described above, the first pixel PX1 may be the white pixel, and the second pixel PX2 may be a pixel to display one of the red color, green color, and blue color.

The display panel 110 may include a first substrate 111, a second substrate 112, and a liquid crystal (LC) layer. The display panel 110 having the above structure may be referred to as an LC display panel 110.

The first substrate 111 may include a first base substrate 113, a first pixel electrode PE1, a second pixel electrode PE2, and a first insulation film 114. The first and second pixel electrodes PE1 and PE2 may correspond to the first and second pixels PX1 and PX2, respectively. The first and second pixel electrodes PE1 and PE2 may be disposed on the first base substrate 113. The first insulation film 114 may be disposed on the first base substrate 113 to cover the first and second pixel electrodes PE1 and PE2.

Although not illustrated in FIG. 2, the first substrate 111 may include thin film transistors to correspond to the first and second pixels PX1 and PX2. In other words, the first and second pixels PX1 and PX2 include the thin film transistors and the first and second pixel electrodes PE1 and PE. The thin film transistors may be connected to the corresponding gate lines GL1-GLn, the corresponding data lines DL1-DLm, and the corresponding first and second pixel electrodes PE1 and PE2.

The thin film transistors may be turned on according to the gate signals provided through the corresponding gate lines GL1-GLn. The turned-on thin film transistors may receive the data voltages from the corresponding data lines DL1-DLm. The thin film transistors may provide the data voltages to the corresponding first and second pixel electrodes PE1 and PE2.

The LC layer may be disposed between the first substrate 111 and the second substrate 112. Although not illustrated in FIG. 2, the LC layer may include LC molecules.

The LC layer of the first pixel PX1 may have a first thickness "d1." The LC layer of the second pixel PX2 has a second thickness "d2." As illustrated in FIG. 2, the second thickness "d2" may be less than the first thickness "d1."

The second pixel PX2 may further include a color filter CF disposed at a bottom portion of the LC layer. The color filter CF may be a color filter that transmits a color that the second pixel PX2 displays. Although FIG. 2 illustrates the color filter CF disposed at the bottom portion of the LC layer, the color filter CF may be disposed at a top portion of the LC layer. A difference between the first thickness "d1" of the LC layer of the first pixel PX1 and the second thickness "d2" of the LC layer of the second pixel PX2 may be caused by the color filter CF. The difference between the first thickness "d1" and the second thickness "d2" may be the same as a thickness of the color filter CF.

The second substrate 112 may include a second base substrate 115, a common electrode CE, and a second insulation film 116. The common electrode CE may be disposed on the second base substrate 115. The second insulation film 116 may be disposed on the common is electrode CE. A common voltage Vcom may be supplied to the common electrode CE. The common voltage Vcom may be a voltage of a predetermined DC level.

Electrical fields may be generated between the common electrode CE and the first and second pixel electrodes PE1 and PE2 according to differences between the common voltage Vcom supplied to the common electrode CE and the data voltages supplied to the first and second pixel electrodes PE1 and PE2, respectively. The LC molecules of the LC layer may be driven by the electrical fields formed between the common electrode CE and the first and second pixel electrodes PE1 and PE2, respectively. As a result, the transmittance of light transmitting through the LC layer changes to display an image.

Although not illustrated in the drawings, the display apparatus 100 may further include a backlight disposed at a rear portion of the display panel 110 to provide light to the display panel 110.

The transmittance (or luminance) of light transmitting through the LC layer varies according the transmittance anisotropy Δn of the LC and a thickness "d" of the LC layer. Also, a response speed of the LC varies according to the transmittance anisotropy Δn of the LC and the thickness "d" of the LC layer. The transmittance anisotropy Δn is defined by a difference between a refractive index "ne" of a long axis of an LC molecule and a refractive index "no" of a short axis of the LC molecule. In the description below, a product of the transmittance anisotropy Δn of the LC and the thickness "d" of the LC layer may be abbreviated to Δnd.

Since the LC layer of the first pixel PX1 has the first thickness "d1," the light transmittance and the response speed of the first pixel PX1 are determined by the transmittance anisotropy Δn of the LC and the first thickness "d1" of the LC layer. On the other hand, since the LC layer of the second pixel PX2 has the second thickness "d2," the light transmittance and response time of the second pixel PX are determined by the transmittance anisotropy Δn of the LC and the second thickness "d2" of the LC layer. Accordingly, when the same data voltage is supplied to the first pixel electrode PE1 and the second pixel electrode PE2, the light transmittance and the response speed of the first pixel PX1 may be different from the light transmittance and the response speed of the second pixel PX2. For example, when a data voltage of 8V is supplied to the first pixel electrode PE1 and the second pixel electrode PE2, light transmittance of the first pixel PX1 may be about 0.05% and the light transmittance of the second pixel PX2 may be about 0.40%.

Figure 3:
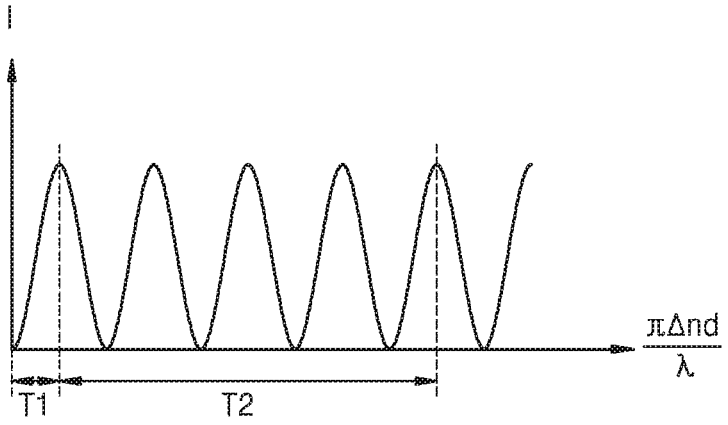
FIG. 3 is a graph illustrating the light transmittance of a liquid crystal layer according to an exemplary embodiment.

FIG. 3 is a graph illustrating the light transmittance of an LC layer according to an exemplary embodiment.

The transmittance (or luminance) of the light transmitting through the LC layer is expressed as the following mathematical Formula 1.

$$I = I_0 \sin^2(2\Theta)\sin^2\left(\frac{\pi\Delta nd}{\lambda}\right) \quad \text{(Formula 1)}$$

Here, I is the light transmittance of the LC layer. Δn is the transmittance anisotropy of the LC of the LC layer. d is a thickness (or cell gap) of the LC layer. λ is a wavelength of light. Δn=ne−no. ne is a refractive index of a long axis of an LC molecule of the LC layer, and no is a refractive index of a short axis of the LC molecule of the LC layer.

θ is an alignment angle of an optical axis of the LC molecule with respect to a polarization axis of a polarizer (not illustrated). The alignment angle of the optical axis of the LC molecule is predetermined. For example, when the optical axis of the LC molecule has an angle of 45 degrees with respect to the polarization axis of the polarizer, θ=45°. In this case, because $\sin^2(2\theta)$ is a fixed value, the transmittance of the light transmitting through the LC layer is expressed as $I=I_0 \sin^2(\pi\Delta nd/\lambda)$.

As such, the light transmittance I is determined by a product of the transmittance anisotropy Δn of the LC and the thickness d of the LC layer. Accordingly, the light transmittance I is expressed as the graph illustrated in FIG. 3.

In FIG. 3, a section of an X axis where the light transmittance I is less than a first maximum value is defined as a first section T1. The first section T1 is defined as a section in which values of (πΔnd/λ) correspond to values of the light transmittance I are less than the first maximum value of the light transmittance I of the first section T1.

In FIG. 3, a section of the X axis where the light transmittance "I" is between the first maximum value and a fifth maximum value is defined as a second section T2. That is, the second section T2 is defined as a section where the value of (πΔnd/λ) corresponds to the light transmittance "I" between the first maximum value and the fifth maximum value.

According to an exemplary embodiment, the value of Δnd (that is Δnd1) of the first pixel PX1 is one of the values of Δnd corresponding to the second section T2, and the value of Δnd (that is Δnd2) of the second pixel PX2 is one of the values of Δnd corresponding to the first section T1. In other words, in the second pixel PX2, since the value of Δnd (that is Δnd2) of the second pixel PX2 is in the first section T1, the light transmittance I is monotonically increased according to increase of a voltage supplied to the second pixel PX2. However, in the first pixel PX1, because the value of Δnd (that is Δnd1) of the first pixel PX1 is in the second section T2, the light transmittance I increases and then decreases according to increase of the voltage supplied to the first pixel PX1.

According to an exemplary embodiment, a product (Δnd1) of the light transmittance anisotropy Δn of the LC layer and the first thickness d1 is greater than a first is minimum condition, and a product (Δnd2) of the light transmittance anisotropy Δn of the LC layer and the second thickness d2 is below the first minimum condition. The first minimum condition corresponds to the first maximum value of FIG. 3.

According to an exemplary embodiment, the product (Δnd1) of the light transmittance anisotropy Δn of the LC layer and the first thickness d1 is greater than 550 nm, and the product (Δnd2) of the light transmittance anisotropy Δn of the LC layer and the second thickness d2 is below 550 nm. Generally, a wavelength of the light is 550 nm.

Figure 4:
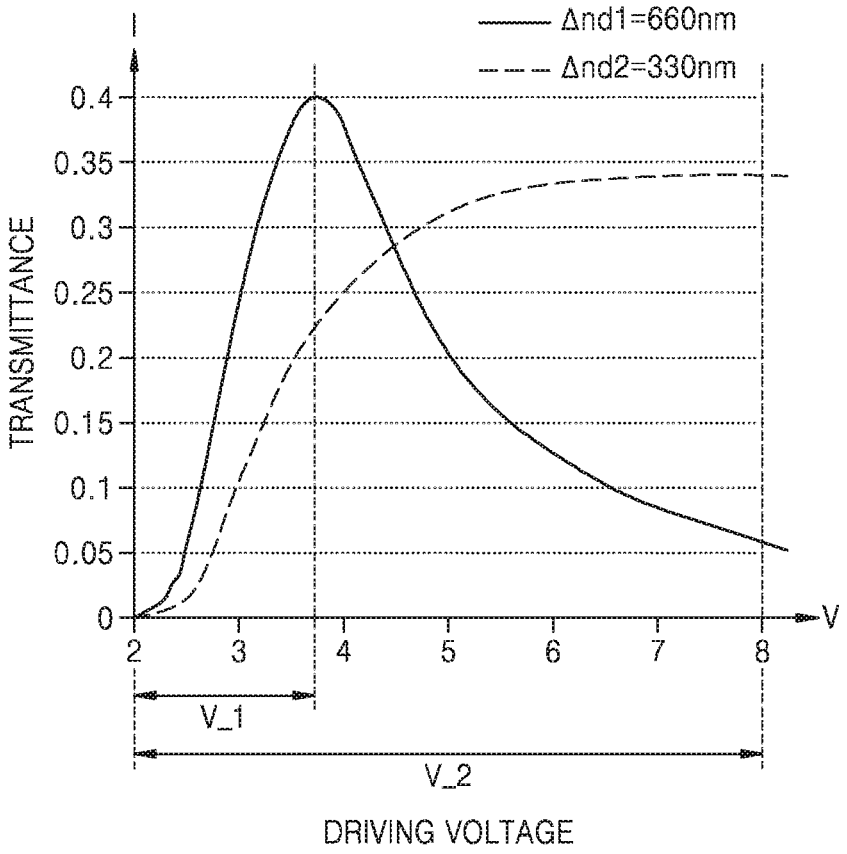
FIG. 4 is a graph illustrating a relationship between a voltage and light transmittance in a first pixel and a second pixel of a display apparatus according to an exemplary embodiment.

FIG. 4 is a graph illustrating a relationship between a voltage and light transmittance I in a first pixel and a second pixel of a display apparatus according to an exemplary embodiment.

In FIG. 4, an X axis is a driving voltage V to drive the LC, and a Y axis is the light transmittance I. In FIG. 4, a solid line represents a relationship between a voltage and light transmittance of a first pixel PX1 when a value of Δnd (that is Δnd1) is 660 nm, and a broken line represents a relationship between a voltage and light transmittance of a second pixel PX2 when a value of Δnd (that is Δnd2) is 330 nm.

As described above, the value of Δnd (that is Δnd1) of the first pixel PX1 is included in the second section T2 of FIG. 3, and the value of Δnd (that is Δnd2) of the second pixel PX2 is included in the second section T2 of FIG. 3.

In an exemplary embodiment, Δnd1 is 660 nm and Δnd2 is 330 nm. For example, the light transmittance anisotropy Δn may be 0.2, the first thickness d1 may be 3.3 μm, and the second thickness d2 may be 1.7 μm.

When the value of Δnd (that is Δnd1) is 660 nm in the first pixel PX1, the light transmittance I increases from a time when a voltage of 2 V is applied to the first pixel PX1 and is then becomes a maximum value at a time when the voltage of 3.7 V is applied to the first pixel PX1. When the voltage higher than 3.7 V is applied to the first pixel PX1, the light transmittance I decreases. When the voltage of 8V or more is applied to the first pixel PX1, the light transmittance I becomes close to zero. In the relationship between the light transmittance I and the voltage V of the first pixel PX1, when voltages corresponding to a region in which the light transmittance I increases from a minimum value to a maximum value may be defined as a first driving voltage section V_1. In an exemplary embodiment, the first driving voltage section V_1 may be set to a range from about 2 V to about 3.7 V. In other words, a voltage corresponding to the first driving voltage section V_1 (i.e., a voltage from about 2 V to about 3.7 V) is necessary to drive the first pixel PX1.

When the value Δnd (that is Δnd2) is 330 nm in the second pixel PX2, the light transmittance I increases from a time when a voltage of 2 V is applied to the second pixel PX2 and then is not increased any more when the voltage higher than 8 V is applied to the second pixel PX2. In the relationship between the light transmittance I and the voltage V of the second pixel PX2, when voltages corresponding to a region in which the light transmittance I increases from a minimum value to a maximum value may be defined as a second driving voltage section V_2. In an exemplary embodiment, the second driving voltage section V_2 may be set to a range from about 2 V to about 8 V. In other words, a voltage corresponding to the second driving voltage section V_2 (i.e., a voltage from about 2 V to about 8 V) is necessary to drive the second pixel PX2.

The first pixel PX1 may drive the LC molecules with a voltage lower than the second pixel PX2. Moreover, a maximum light transmittance of the first pixel PX1 may be higher than a maximum light transmittance of the second pixel PX2. Accordingly, power is consumption to drive the first pixel PX1 may decrease. However, there may be a problem of a low response speed due to a low driving voltage of the first pixel PX1.

Figure 5:
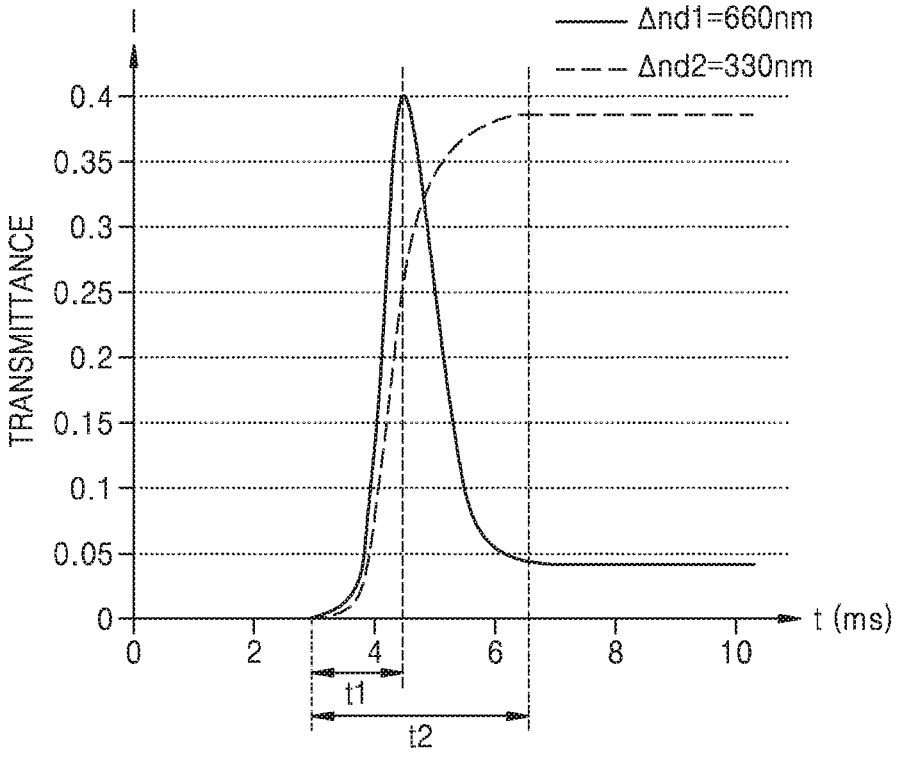
FIG. 5 is a graph illustrating a relationship between a response speed and light transmittance in a first pixel and a second pixel of a display apparatus according to an exemplary embodiment.

FIG. 5 is a graph illustrating a relationship between a response speed and light transmittance in a first pixel and a second pixel of a display apparatus according to an exemplary embodiment.

Referring to FIG. 5, an X axis is the response time of the LC, and a Y axis is the light transmittance. In FIG. 5, a solid line of the graph illustrates a relationship between the response speed and the light transmittance of the first pixel PX1 when the value Δnd (that is Δnd1) is 660 nm. A broken line of FIG. 5 illustrates a relationship between the response time and the light transmittance of the second pixel PX2 when the value Δnd (that is Δnd2) is 330 nm.

Changes of the light transmittance with respect to time are illustrated when the same voltage, for example, a voltage of 8 V, is applied to the first pixel PX1 of which a value of Δnd (that is Δnd1) is 660 nm and the second pixel PX2 of which a value of Δnd (that is Δnd2) is 330 nm.

In the first pixel PX1, it takes a first time period t1 until the light transmittance I becomes a maximum value. The first time period t1 is about 1.5 ms in FIG. 5. In the first pixel PX1, the light transmittance I decreases after the first time period T1.

In the second pixel PX2, the light transmittance I is saturated after the second time period t2. The second time period t2 is about 3.6 ms. As illustrated in FIG. 5, the first time period t1 is shorter than the second time period t2.

Accordingly, when the value Δnd (that is Δnd1) is 660 nm in the first pixel PX1, and when a voltage higher than the voltages of the first driving voltage section V_1 to drive the first pixel PX1 is instantly applied to the first pixel PX1, a response speed of the first pixel PX1 is may be improved more than the second pixel PX2 of which a value Δnd (that is Δnd2) is 660 nm in the second pixel PX2. The voltage instantly applied to the first pixel PX1 to improve the response time of the LC may be referred to an overdriving voltage. Although the overdriving voltage is a voltage higher than voltages of the first driving voltage section V_1 of FIG. 4, the overdriving voltage may be a voltage within the second driving voltage section V_2.

Figure 6:
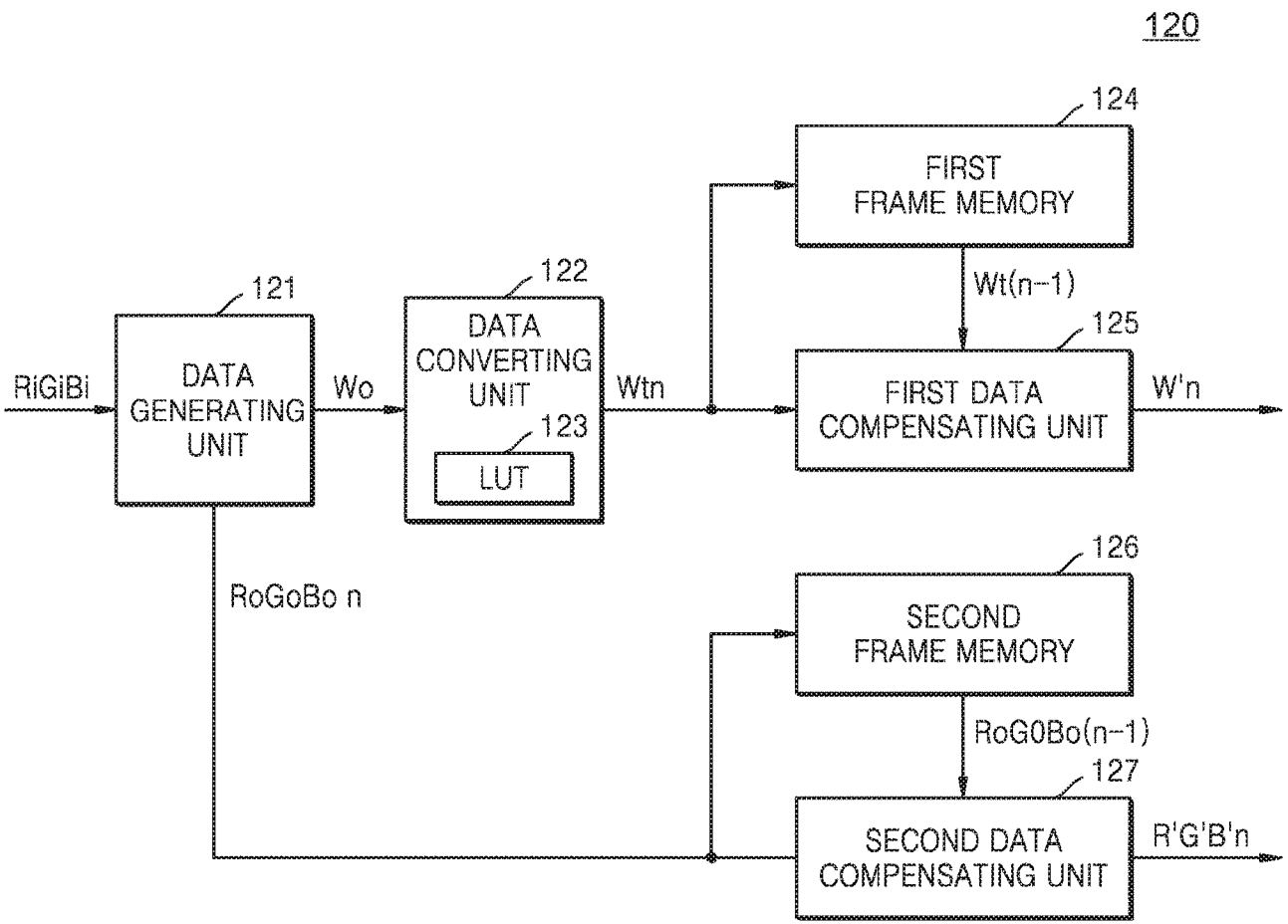
FIG. 6 is a block diagram illustrating a timing controller of a display apparatus according to an exemplary embodiment.

FIG. 6 is a block diagram illustrating the timing controller 120 of the display apparatus 100 according to an exemplary embodiment.

Referring to FIG. 6, the timing controller 120 may include a data generating unit 121, a data converting unit 122, a first frame memory 124, and a first data compensating unit 125.

The data generating unit 121 may generate a first image signal corresponding to a first pixel and a second image signal corresponding to a second pixel in response to an input image signal RiGiBi.

The data generating unit 121 may receive the input image signal RiGiBi from outside the timing controller 120 (e.g., from a system board). The input image signal RiGiBi may include red pixel data, green pixel data, and blue pixel data. The data generating unit 121 may generate image signals including white pixel data from the input image signal RiGiBi.

As described above, the first pixel may include an LC layer of a first thickness d1 and may be a white pixel. The second pixel may have an LC layer of a second thickness d2 less than the first thickness d1 of the first pixel. The second pixel may include a color filter disposed at a bottom or top portion of the LC layer. The second pixel may be a pixel to display one of a red color, a green color, and a blue color. A thickness of the color filter may be the same as a difference between the first thickness d1 and the second thickness d2. The thicknesses of the LC is layers of the red pixel, green pixel, and blue pixels may be different from one another, and the second pixel may be a red pixel, a green pixel, or a blue pixel.

The data generating unit 121 may generate a first image signal Wo corresponding to the first pixel from the input image signal RiGiBi and a second image signal RoGoBo corresponding to the second pixel from the input image signal RiGiBi. Although RoGoBo is a reference provided to the second image signal, the second image signal may represent an image signal corresponding to a color displayed by the second pixel. In other words, when the second pixel is the red pixel, Ro is a reference of the second image signal.

For example, the first image signal Wo may be determined to be a minimum value among the input image signals RiGiBi or a product of the minimum value and a predetermined coefficient a. In other words, the first input signal Wo may be determined by min[Ri, Gi, Bi] or a×min[Ri. Gi. Bi]. Here, the coefficient a may be greater than zero (0) and less than one (1). Ro, Go, and Bo may be determined as Ri-Wo, Gi-Wo, and Bi-Wo, respectively. The coefficient a may be determined by taking into account a state, temperature, deterioration of the color filter of the LC.

The data converting unit 122 may convert a gradation value of the first image signal Wo into a conversion gradation value of the first image signal according to the refractive index anisotropy Δn of the LC layer and a first thickness d1 of the LC layer to output the conversion gradation value of the first image signal.

The data converting unit 122 may convert the gradation value of the first image signal Wo to be suitable to the first pixel having the value of Δnd (that is Δnd1). The converted gradation value is referred to as the conversion gradation value, and the first image signal having the conversion gradation value is referred to as a first image conversion signal Wtn. The is conversion gradation value may be determined according to a product (Δnd1) of the refractive index anisotropy Δn of the LC layer and a first thickness d1 of the LC layer. The conversion gradation value may be determined based on the light transmittance of the first pixel which may be determined according to the product (that is Δnd1) of the refractive index anisotropy Δn of the LC layer and the first thickness "d1" of the LC layer.

The data converting unit 122 may further include a look-up table 123 (also LUT in FIG. 6). The look-up table 123 may define the conversion of the gradation value of the first image signal Wo according to a relationship between the light transmittance of the first pixel and a data voltage applied to the first pixel. The look-up table 123 may define the conversion of the gradation value of the first image signal Wo according to a relationship between the light transmittance and a driving voltage of the first pixel, as illustrated in FIG. 4. The look-up table 123 may store gradation values corresponding to the first pixel (values of Δnd1). The gradation values corresponding to the first pixel may be gradation values corresponding to voltages in the first driving voltage section V_1, as illustrated in FIG. 4.

For example, when the gradation value of the first image signal Wo is 255G, a data driving unit may output a data voltage of 8V to the first pixel if there is no conversion of the gradation value by the data converting unit 122. However, when the data voltage of 8V is applied to the first pixel, the light transmittance or luminance corresponding to the gradation value of 255G may not be displayed because the light transmittance is 0.05%. The data converting unit 122 may convert the gradation value of the first image signal Wo to a gradation value to supply the data voltage of 3.2V to the first pixel so that the first pixel displays the light transmittance or luminance corresponding to the gradation value of 255G. The look-up table 123 may define a mapping relationship of the gradation values. The data converting unit 122 may convert the gradation value of the first image signal Wo to generate the first image conversion signal Wtn having the conversion gradation value.

The first image conversion signal Wtn may be generated from the data converting unit 122 and may be supplied to the first frame memory 124 and the first data compensating unit 125.

The first frame memory 124 may receive the first image conversion signal Wtn, store the received first image conversion signal Wtn for a period of a frame, and then output the stored first image conversion signal Wtn. Accordingly, when the data converting unit 122 outputs the first image conversion signal Wtn of a current frame, the first frame memory 124 may output a first image conversion signal Wt(n−1) of a previous frame. The first data compensating unit 125 may receive the first image conversion signal Wtn of the current frame from the data converting unit 122 and the first image conversion signal Wt(n−1) of the previous frame from the first frame memory 124.

The first data compensating unit 125 may generate a compensation gradation value of a first image signal W'n according to the conversion gradation value of the first image conversion signal Wtn of the current frame received from the data converting unit 122 and the conversion gradation value of the first image signal Wt(n−1) of the previous frame received from the first frame memory 124.

According to an exemplary embodiment, when the conversion gradation value of the first image conversion signal Wtn received from the data converting unit 122 is the same as the conversion gradation value of the first image conversion signal Wt(n−1) received from the first frame memory 124, the first data compensating unit 125 may generate the first image conversion signal Wtn without compensating for the gradation value. In this case, the data driver 140 may receive the first image conversion signal Wtn and outputs to the first pixel a first data voltage corresponding to the conversion gradation value of the first image conversion signal Wtn. The first data voltage is a voltage selected from the first driving voltage section V_1 of FIG. 4 to correspond to the conversion gradation value. The LC layer of the first pixel may have the light transmittance corresponding to the first data voltage in response to the first data voltage.

When the conversion gradation value of the first image conversion signal Wtn received from the data converting unit 122 is greater than the conversion gradation value of the first image conversion signal Wt(n−1) received from the first frame memory 124 by a predetermined value, the first data compensating unit 125 may compensate for the conversion gradation value of the first image conversion signal Wtn of the current frame and may output the first image compensation value W'n having the compensation gradation value. In this case, the data driver 140 may receive the first image compensation signal W'n having the compensation gradation value from the first data compensating unit 125 and may output an overdriving voltage corresponding to the compensation gradation value to the first pixel. The overdriving voltage may be a voltage higher than the first driving voltage section V_1. In other words, when the first driving voltage section is from about 2 V to about 3.7 V, the overdriving voltage may be higher than about 3.7 V. For instance, the overdriving voltage may be about 8 V. The overdriving voltage may be a voltage selected to quickly increase the light transmittance as illustrated in the graph of FIG. 5.

According to an exemplary embodiment, the overdriving voltage is set such that the light transmittance of the first pixel after the overdriving voltage is applied to the first pixel is less than the light transmittance of the first pixel after a maximum voltage of the first driving voltage section V_1 is applied to the first pixel. The value of Δnd (that is Δnd1) of the first pixel is may be greater than the first minimum condition. When the maximum voltage of the first driving voltage section V_1 is applied to the first pixel, the first pixel may have a maximum light transmittance. However, because the value of Δnd (that is Δnd1) of the first pixel is greater than the first minimum condition, the first pixel may have light transmittance lower than the maximum light transmittance when the overdriving voltage higher than the first driving voltage section V_1 is applied to the first pixel. However, in this case, the first pixel may have a fast response speed. Since the first thickness d1 of the LC layer is getting thicker, a small movement of the LC molecules causes a big increase of the light transmittance.

The overdriving voltage may be supplied to the first pixel during a period of a frame only. As illustrated in FIG. 5, when the overdriving voltage is supplied to the first pixel for more than the period of the frame, the light transmittance may decrease.

The timing controller 120 may further include a second frame memory 126 and a second data compensating unit 127.

The second frame memory 126 may receive the second image signal RoGoBon from the data generating unit 121, store the received second image signal RoGoBon for a period of a frame, and then output the stored second image signal RoGoBon. Accordingly, when the data generating unit 121 outputs the second image signal RoGoBon of a current frame, the second frame memory 126 may output the second image signal RoGoBo(n−1) of a previous frame.

The second data compensating unit 127 may receive the second image signal RoGoBon of the current frame from the data generating unit 121 and the second image signal RoGoBo(n−1) of the previous frame from the second frame memory 126.

The second data compensating unit 127 may generate a second image compensation signal R'G'B'n having the compensation gradation value according to the second image signal RoGoBon of the current frame and the second image signal RoGoBo(n−1) of the previous frame.

The data driver 140 may output the second data voltage corresponding to the compensation gradation value of the second image compensation signal R'G'B'n to the second pixel. As described above, the second data voltage is a voltage corresponding to the compensation gradation value within the second driving voltage section V_2 of FIG. 4. The overdriving voltage corresponding to the compensation gradation value generated by the first data compensating unit 125 may be included in the second driving voltage section V_2. Accordingly, an additional voltage generating unit to generate the overdriving voltage may not be required.

Figure 7:
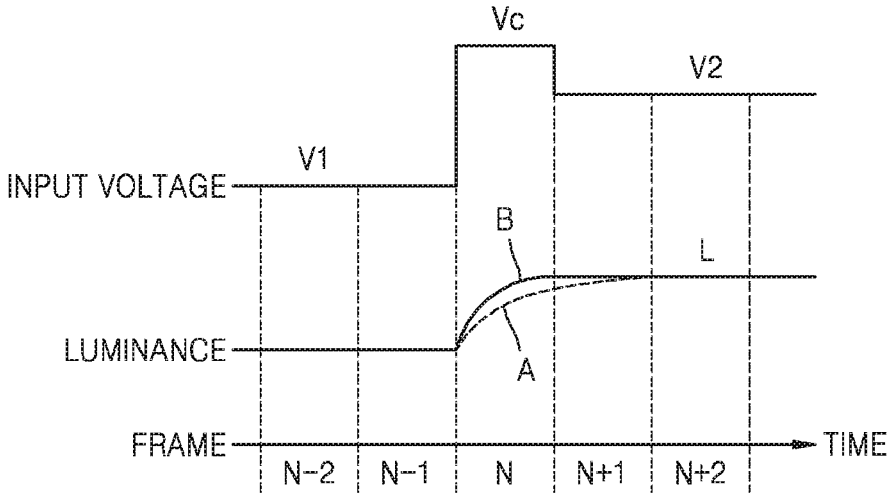
FIG. 7 is a graph illustrating a data compensating unit of a display apparatus according to an exemplary embodiment.

FIG. 7 is a graph illustrating a data compensating unit of a display apparatus according to an exemplary embodiment.

Referring to FIG. 7, a gradation value of an image signal of a previous frame N−1 corresponds to a first target voltage, and a gradation value of an image signal of a current frame N corresponds to a second target voltage higher than the first target voltage.

A difference between the gradation value of the image signal of the previous frame N−1 and the gradation value of the image signal of the current frame N is greater than a predetermined value. A target luminance L required in the current frame N may not be achieved even when the second target voltage is applied to the LC. For example, as illustrated in a curve A of FIG. 7, a luminance of a pixel PX may not reach the target luminance L during a period of the current frame N, and the luminance of the pixel PX may reach the target luminance L after a period of two frames.

The second data compensating unit 127 may compare the second image signal RoGoBon of the current frame N and the second image signal RoGoBo(n−1) of the previous frame N−1. According to the comparison result, the second data compensating unit 127 compensates for the gradation value of the second image signal RoGoBon of the current frame. For example, the second data compensating unit 127 compensates for the gradation value of the second image signal RoGoBon of the current frame N when a difference between the gradation value of the second image signal RoGoBon of the current frame N and the gradation value of the second image signal RoGoBo(n−1) of the previous frame N−1 is greater than the predetermined value. The second data compensating unit 127 may output to the data driver 140 the second image compensation signal R'G'B'n of which gradation value is compensated.

The data driver 140 may receive the second image compensation signal R'G'B'n of which gradation value is compensated by the second data compensating unit 127 and may output to the second pixel a compensation voltage Vc corresponding to the compensation gradation value. The compensation voltage Vc may be a voltage higher than the second target voltage of the second driving voltage section V_2. As a result, when the compensation voltage Vc is higher than the second target voltage applied to the LC in the period of the current frame N, a rising time decreases such that the pixel may reach the target luminance L in the period of the current frame N as illustrated in a curve B of FIG. 7.

The first data compensating unit 125 may compensate for the conversion gradation value of the first image conversion signal Wtn of the current frame N when a difference between the conversation gradation value of the first image conversion signal Wtn of the current frame N and the conversion gradation value of the first image conversion signal Wt(n−1) of the previous frame N−1 is greater than a predetermined value. The first data is compensating unit 125 may output to the data driver 140 the first image signal W'n having the compensation gradation value in which the conversion gradation value is compensated.

The data driver 140 may receive the first image signal W'n having the compensation gradation value from the first data compensating unit 125 and outputs the overdriving voltage corresponding to the compensation gradation value to the first pixel. Since the second target voltage V2 is a voltage to be applied to the first pixel, the second target voltage V2 may be a voltage in the first driving voltage section V_1. The overdriving voltage may be higher than the first driving voltage section V_1, compared to the above-described compensation voltage Vc. Also, the overdriving voltage may be applied to the first pixel during a limited period of time as illustrated in FIG. 5. Moreover, as illustrated in FIG. 4, the light transmittance of the first pixel when the overdriving voltage is applied to the first pixel may be lower the light transmittance of the first pixel when the second target voltage V2 is applied to the first pixel. Nevertheless, as illustrated in FIG. 5, a response speed of the first pixel is improved to quickly reach the target luminance L according to a quick movement of the LC molecules by the overdriving voltage.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display apparatus, comprising:

a display panel comprising a liquid crystal layer, a first pixel having the liquid crystal layer with a first thickness and a second pixel having the liquid crystal layer with a second thickness and having a color filter disposed at a top or bottom portion of the liquid crystal layer, the second thickness is less than the first thickness;

a data generating unit configured to generate a first image signal corresponding to the first pixel and a second image signal corresponding to the second pixel in response to an input image signal;

a data converting unit configured to convert a gradation value of the first image signal into a conversion gradation value of the first image signal according to refractive index anisotropy and the first thickness of the liquid crystal layer;

a first frame memory configured to store the conversion gradation value of the first image signal for a period of a frame;

a first data compensating unit configured to generate a compensation gradation value of the first image signal according to the conversion gradation value of the first image signal generated from the data converting unit and the conversion gradation value of the first image signal stored in the first frame memory; and a driving unit configured to output to the first pixel a first data voltage corresponding to the compensation gradation value of the first image signal.

2. The display apparatus of claim 1, wherein a product of the refractive index anisotropy and the first thickness of the liquid crystal layer is above a first minimum condition, and a product of the refractive index anisotropy and the second thickness of the liquid crystal layer is below the first minimum condition.

3. The display apparatus of claim 1, wherein a product of the refractive index anisotropy and the first thickness of the liquid crystal layer is above 550 nm, and a product of the refractive index anisotropy and the second thickness of the liquid crystal layer is below 550 nm.

4. The display apparatus of claim 1, wherein a thickness of the color filter is the same as a difference between the first thickness and the second thickness.

5. The display apparatus of claim 1, wherein the data converting unit is configured to convert the gradation value of the first image signal into the conversion gradation value such that the conversion gradation value of the first image signal is determined according to a product of the refractive index anisotropy and the first thickness of the liquid crystal layer.

6. The display apparatus of claim 1, wherein the data converting unit is configured to convert the gradation value of the first image signal into the conversion gradation value based on light transmittance of the first pixel determined according to a product of the refractive index anisotropy and the first thickness of the liquid crystal layer.

7. The display apparatus of claim 6, wherein the data converting unit comprises a look-up table to define conversion of the gradation value of the first image signal based on a relationship between the light transmittance of the first pixel and a data voltage applied to the first pixel.

8. The display apparatus of claim 1, wherein:

the first data compensating unit is configured to output the conversion gradation value of the first image signal generated from the data converting unit without compensating for the conversion gradation value when the conversion gradation value of the first image signal of a previous frame stored in the first frame memory and the conversion gradation value of the first image signal of a current frame generated from the data converting unit are the same; and the data driving unit is configured to output to the first pixel the first data voltage within a first driving voltage section corresponding to the conversion gradation value of the first image signal outputted from the first compensating unit.

9. The display apparatus of claim 8, wherein:

the first data compensating unit is configured to output the compensation gradation value of the first image signal by compensating for the conversion gradation value when the conversion gradation value of the first image signal of the current frame generated from the data converting unit is greater than the conversion gradation value of the first image signal of the previous frame stored in the first frame memory by a predetermined value; and the data driving unit is configured to output to the first pixel an overdriving voltage above the first driving voltage section corresponding to the conversion gradation value of the first image signal outputted from the first compensating unit.

10. The display apparatus of claim 9, wherein the overdriving voltage is set such that light transmittance of the first pixel after the overdriving voltage is applied to the first pixel is less than the light transmittance of the first pixel after a maximum voltage of the first driving voltage section is applied to the first pixel.

11. The display apparatus of claim 10, wherein the data driving unit is configured to output to the second pixel a second data voltage of a second driving voltage section comprising the first driving voltage section in response to a gradation value of the second image signal.

12. The display apparatus of claim 11, wherein the second driving voltage section comprises the overdriving voltage.

13. The display apparatus of claim 9, wherein the data driving unit applies the overdriving voltage to the first pixel for the period of the frame.

14. The display apparatus of claim 1, further comprising:

a second frame memory configured to store a gradation value of the second image signal for the period of the frame; and a second data compensating unit configured to generate a compensation gradation value of the second image signal according to the gradation value of the second image signal of a current frame generated from the data generating unit and the gradation value of the second image signal of a previous frame stored in the second frame memory, wherein the data driving unit is configured to output to the second pixel a second data voltage corresponding to the compensation gradation value of the second image signal.

15. A driving method of a display panel, the method comprising:

generating a first image signal corresponding to a first pixel of the display panel and a second image signal corresponding to a second pixel of the display panel, the display panel comprising a liquid crystal layer with a first thickness in the first pixel and a second thickness in the second pixel that is less than the first thickness;

outputting to the first pixel a first data voltage of a first driving voltage section in response to a gradation value of the first image signal when the gradation value of the first image signal of a previous frame and the gradation value of the first image signal of a current frame are the same;

outputting to the first pixel an overdriving voltage higher than the first driving voltage section when the gradation value of the first image signal of the current frame is greater than the gradation value of the first image signal of the previous frame by a predetermined value; and outputting a second data voltage of a second driving voltage section comprising the first driving voltage section in response to the gradation value of the second image signal, wherein the second pixel has a color filter disposed at a top or bottom portion of the liquid crystal layer, wherein the first driving voltage section is determined according to a product of a refractive index anisotropy and the first thickness of the liquid crystal layer, and the second driving voltage section is determined according to a product of the refractive index anisotropy and the second thickness of the liquid crystal layer.

16. The driving method of claim 15, wherein the overdriving voltage is applied to the first pixel during a period of a frame.

17. The driving method of claim 15, wherein the second driving voltage section comprises the overdriving voltage.

18. The driving method of claim 15, wherein the product of the refractive index anisotropy and the first thickness of the liquid crystal layer is above a first minimum condition, and the product of the refractive index anisotropy and the second thickness of the liquid crystal layer is below the first minimum condition.

19. The driving method of claim 15, wherein:

the first driving voltage section is set such that light transmittance of the first pixel increases when the first data voltage applied to the first pixel increases in the first driving voltage section; and the second driving voltage section is set such that light transmittance of the second pixel increases when the second data voltage applied to the second pixel increases in the second driving voltage section.

* * * * *